US008822851B2

(12) United States Patent
Walker et al.

(10) Patent No.: US 8,822,851 B2
(45) Date of Patent: Sep. 2, 2014

(54) METHOD AND APPARATUS FOR CONTROLLING A MULTI-MODE KEYBOARD

(75) Inventors: David Ryan Walker, Waterloo (CA); Steven Henry Fyke, Waterloo (CA)

(73) Assignee: BlackBerry Limited, Waterloo (CA)

( * ) Notice: Subject to any disclaimer, the term of this patent is extended or adjusted under 35 U.S.C. 154(b) by 362 days.

(21) Appl. No.: 12/915,387

(22) Filed: Oct. 29, 2010

(65) Prior Publication Data

US 2012/0103776 A1 May 3, 2012

(51) Int. Cl.
*H01H 13/702* (2006.01)
*H01H 13/83* (2006.01)
*H01H 3/02* (2006.01)

(52) U.S. Cl.
CPC ..... *H01H 13/83* (2013.01); *H01H 2003/0293* (2013.01); *H01H 2219/062* (2013.01); *H01H 2205/016* (2013.01); *H01H 2219/039* (2013.01); *H01H 2227/026* (2013.01); *H01H 13/702* (2013.01); *H01H 2239/074* (2013.01); *H01H 2239/006* (2013.01); *H01H 2231/022* (2013.01)
USPC ..... 200/5 A; 200/512

(58) Field of Classification Search
USPC ..... 200/5 A, 512–520; 345/168; 341/23
See application file for complete search history.

(56) References Cited

U.S. PATENT DOCUMENTS

| | | | | |
|---|---|---|---|---|
| 6,067,074 | A | 5/2000 | Lueders | |
| 6,396,483 | B1 | 5/2002 | Hiller | |
| 7,138,985 | B2 | 11/2006 | Nakajima | |
| 7,574,535 | B2 * | 8/2009 | Finkelstein | 710/15 |
| 7,606,483 | B2 | 10/2009 | Kurosawa | |
| 7,829,812 | B2 * | 11/2010 | Tolbert et al. | 200/5 A |
| 7,935,904 | B2 * | 5/2011 | Song | 200/512 |
| 2003/0025679 | A1 | 2/2003 | Taylor et al. | |
| 2005/0073446 | A1 | 4/2005 | Lazaridis et al. | |
| 2007/0029172 | A1 | 2/2007 | Choi et al. | |
| 2007/0279388 | A1 | 12/2007 | Pletikosa | |
| 2008/0094373 | A1 | 4/2008 | Song | |
| 2009/0008234 | A1 | 1/2009 | Tolbert et al. | |
| 2009/0046065 | A1 | 2/2009 | Liu et al. | |
| 2009/0174687 | A1 | 7/2009 | Ciesla et al. | |
| 2009/0284397 | A1 | 11/2009 | Lee et al. | |

FOREIGN PATENT DOCUMENTS

| | | | |
|---|---|---|---|
| EP | 1837174 | A1 | 9/2007 |
| EP | 2 175 349 | A1 | 4/2010 |
| WO | 2007/139349 | A1 | 12/2007 |

OTHER PUBLICATIONS

Firefly flyPhone, http://www/fireflymobile.com/flyphone.
Sharp WS020SH, http://pocketnow.com/hardware-1/a-winmo-phone-with-a-morphing-keypad.
European Patent Application No. 101895241 Partial European Search Report mailed date Apr. 7. 2011.
Handbook for Palm-Handhelds Series m500 Internet Citation, Jan. 1, 2001, p. 290PP, XP007905647, Retrieved from the Internet: URL:http://www.heise.de/newsticker/Palm-m500-und-m505-in-Europa-lieferbar-/meldung/18163 [retrieved on Sep. 11, 2008].
European Patent Application No. 101895241 Extended Search Report dated Jul. 20, 2011.

* cited by examiner

*Primary Examiner* — Amy Cohen Johnson
*Assistant Examiner* — Marina Fishman
(74) *Attorney, Agent, or Firm* — Perry + Currier Inc.

(57) ABSTRACT

A multi-mode keyboard for a portable electronic device is provided. The keyboard comprising: a layer of flexible transparent touch sensors for receiving touch input; a layer of flexible output device; and a dome sheet for receiving key click input.

20 Claims, 15 Drawing Sheets

METHOD AND APPARATUS FOR CONTROLLING A MULTI-MODE KEYBOARD

FIELD

The specification relates generally to keyboards, and specifically to a method and apparatus for controlling a multi-mode keyboard of a portable electronic device.

BACKGROUND

Portable electronic devices, such as a cellular telephone or personal digital assistants ("PDA"), are capable of ever diverse functionalities. Being able to provide diverse functionalities generally necessitate the capability of accepting disparate forms of input. Keyboards of portable electronic devices generally lack space; the lack of space makes it difficult to provide means to receive disparate forms of input.

BRIEF DESCRIPTIONS OF THE DRAWINGS

Implementations are described with reference to the following figures, in which.

DETAILED DESCRIPTION OF THE IMPLEMENTATIONS

Figure 1:
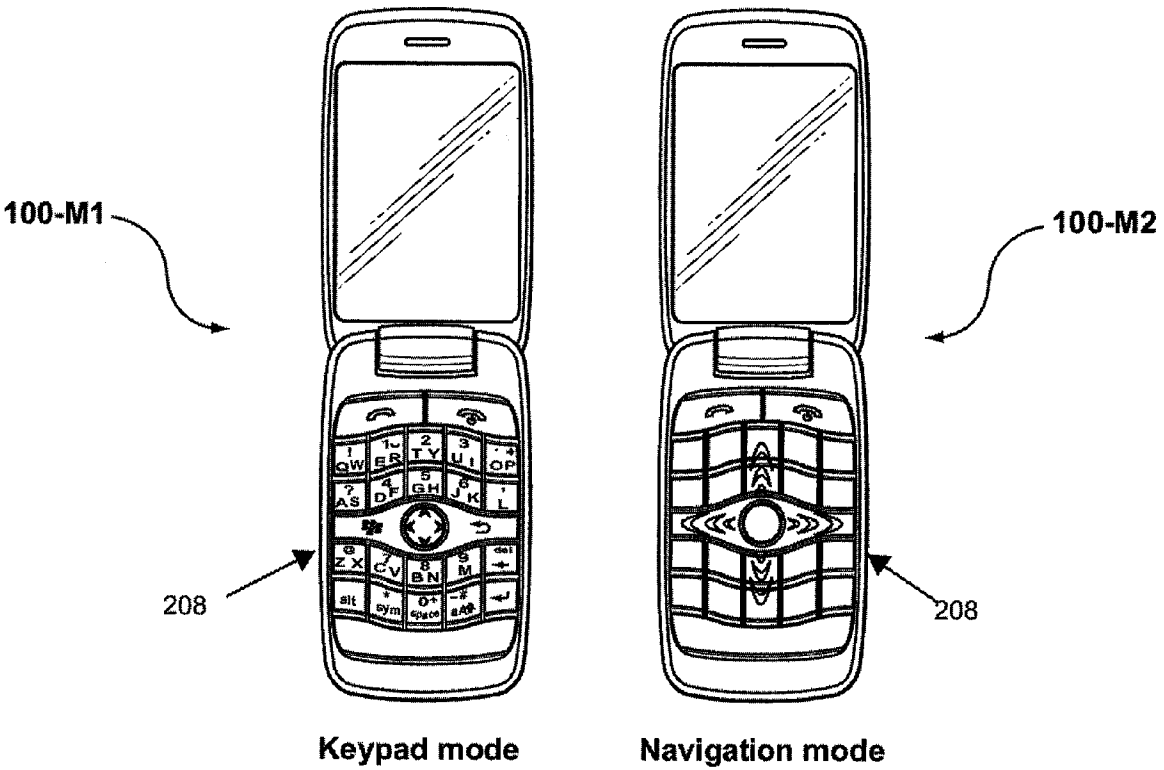
FIG. 1 is a front view of a portable electronic device operating in two modes, according to an implementation.

An aspect of this specification provides a multi-mode keyboard for a portable electronic device, the keyboard comprising: a layer of flexible transparent touch sensors for receiving touch input; a layer of flexible output device; and a dome sheet for receiving key click input.

The keyboard can be configured for switching from a first mode to a second mode. The first mode can be an alphanumeric keypad mode and the second mode can be a navigation mode. The keyboard can be configured for switching from a key click input mode to a touch input mode.

The layer of flexible output device can comprise: a first light guide film having first indicia viewable when the multi-mode keyboard is operating in the first mode; and a second light guide film having second indicia viewable when the multi-mode keyboard is operating in the second mode.

The first indicia can comprise at least alphanumeric characters. The second indicia can comprise a plurality of navigation characters.

The second indicia can include one of a telephone dial pad, a gaming layout, a symbol layout, a gesture arrow layout and a command layout.

The multi-mode keyboard can further comprise a layer of keycaps.

The multi-mode keyboard can further include a printed circuit board having a plurality of circuit traces. The dome sheet can include a plurality of domes, each dome can be in alignment with a corresponding circuit trace.

The layer of flexible output device can comprise a layer of flexible display for displaying first indicia when the multi-mode keyboard is operating in a first mode and for displaying second indicia when the multi-mode keyboard is operating in a second mode.

Another aspect of this specification provides a method for controlling a multi-mode keyboard comprising: receiving first input data via the keyboard; and if the first input data results in a key click input received from a first input key, switching the multi-mode keyboard from an inactive mode to a first mode displaying a first indicia on the keyboard; if the first input data results in a key-click input received from a second input key, switching the multi-mode keyboard from the inactive mode to a second mode displaying a second indicia on the keyboard.

The method can further comprise: receiving second input data from the keyboard; and if the second input data is a touch input or a key click input received from the second input key, switching the keyboard from the first mode to the second mode; if the second input data is a key click input received from the first input key, switching from the second mode to the first mode.

The first mode can be a keypad mode and the second mode can be a navigation mode.

The first input key can be a non-navigation key and the second input key can be a navigation key.

The first indicia and the second indicia can be displayed on a layer of flexible display.

Another aspect of this specification provides a multi-mode keyboard for a portable electronic device having a processor, the keyboard comprising: a layer of flexible transparent touch sensors for receiving touch input; a flexible display layer configured for displaying at least one indicia thereon; a dome sheet for receiving key click input, the dome sheet including a plurality of domes; a printed circuit board including a plurality of circuit traces, each circuit trace corresponding to one of the domes; a layer of keycaps placed on top of said layer of flexible transparent touch sensors, each keycap in alignment with a corresponding one of said domes and a corresponding one of said circuit traces; wherein the keyboard can be configured for switching between a first mode and a second mode based on whether touch input or key click input is received by the processor.

The flexible display layer can be configured for displaying first indicia when the keyboard operates in the first mode, and second indicia when the keyboard operates in the second mode.

The first mode can include a keypad mode and the second mode can include a navigation mode.

FIG. 1 depicts a portable electronic device 100 with its keyboard 208 operating in a first or keypad mode 100-M1 and a second or navigation mode 100-M2. When operating in the keypad mode 100-M1, the portable electronic device 100 displays alphanumeric characters on keyboard 208. When operating in the navigation mode 100-M2, the portable electronic device 100 displays sets of chevrons on keyboard 208. Further details of these modes will be provided below.

Figure 2:
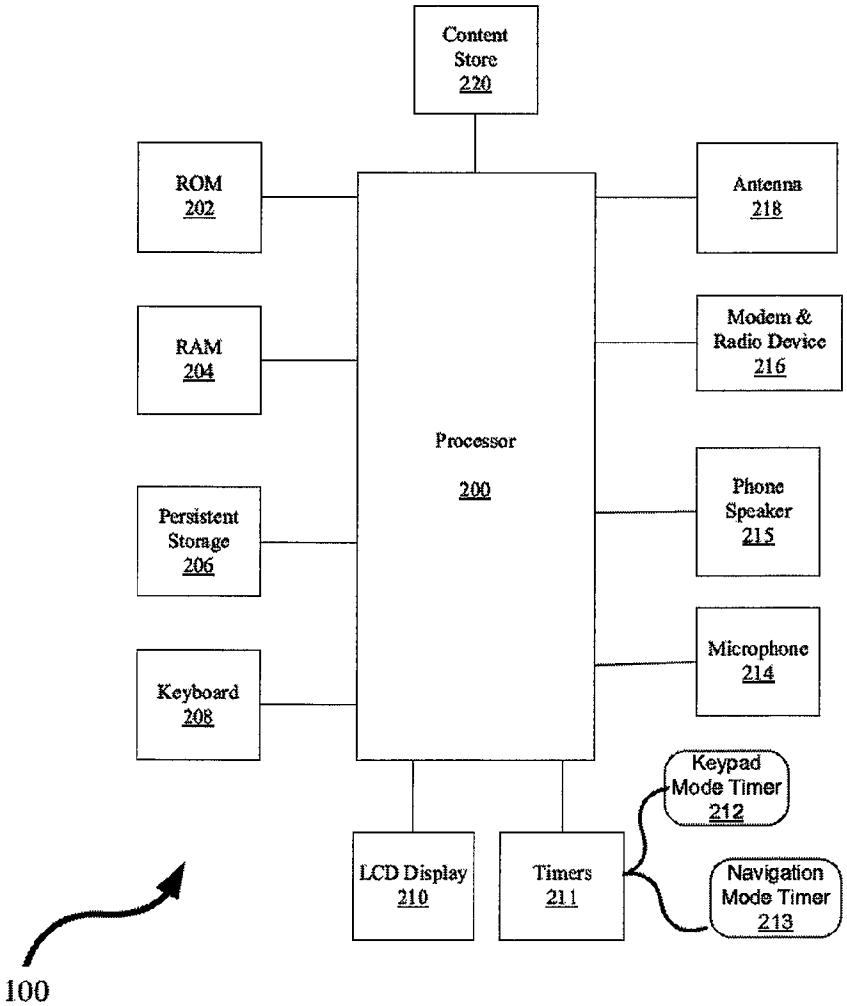
FIG. 2 is a block diagram of components of the portable electronic device of FIG. 1.

Referring now to FIG. 2, a block diagram of certain components within the portable electronic device 100 is shown. In the present implementation, the portable electronic device 100 is a cellular telephone. It will be understood, however, that the portable electronic device 100 is not limited to cellular telephones. Other portable electronic devices are possible, such as a wireless personal digital assistant (PDA).

The portable electronic device 100 includes a processor 200 connected to a read-only-memory (ROM) 202, which stores the boot firmware basic input/output system (BIOS) to be executed when the portable electronic device 100 is turned on. The processor 200 is also connected to a random access memory unit (RAM) 204 and a persistent storage device 206 that contains a plurality of applications executable by the processor 200 that enables the portable electronic device 100 to perform certain functions including, for example, PIN message functions, SMS message functions and cellular telephone functions, and an attachment viewer application for viewing attachments (e.g. document attachments to emails or documents from other sources, such as web servers). The processor 200 receives input from input devices such as the keyboard 208. The processor 200 outputs to various output devices, such as an LCD or touch-sensitive display 210. Timers 211 are connected to processor 200 to implement timers such as a keypad mode timer 212 and a navigation mode timer 213 to switch from one mode of keyboard 208 to another mode (more details of the keypad mode timer 212 and navigation mode timer 213 will be provided below). It is understood that, in some implementations, some or all of timers 211 can also be a part of processor 200. A microphone 214 and a phone speaker 215 are connected to the processor 200 for cellular telephone functions. The processor 200 is also connected to a modem and radio device 216. The modem and radio device 216 is used to connect to wireless networks and transmit and receive voice and data communications through an antenna 218. A content store 220, which is generally a file storage system for the portable electronic device 100, is also provided.

Figure 3:
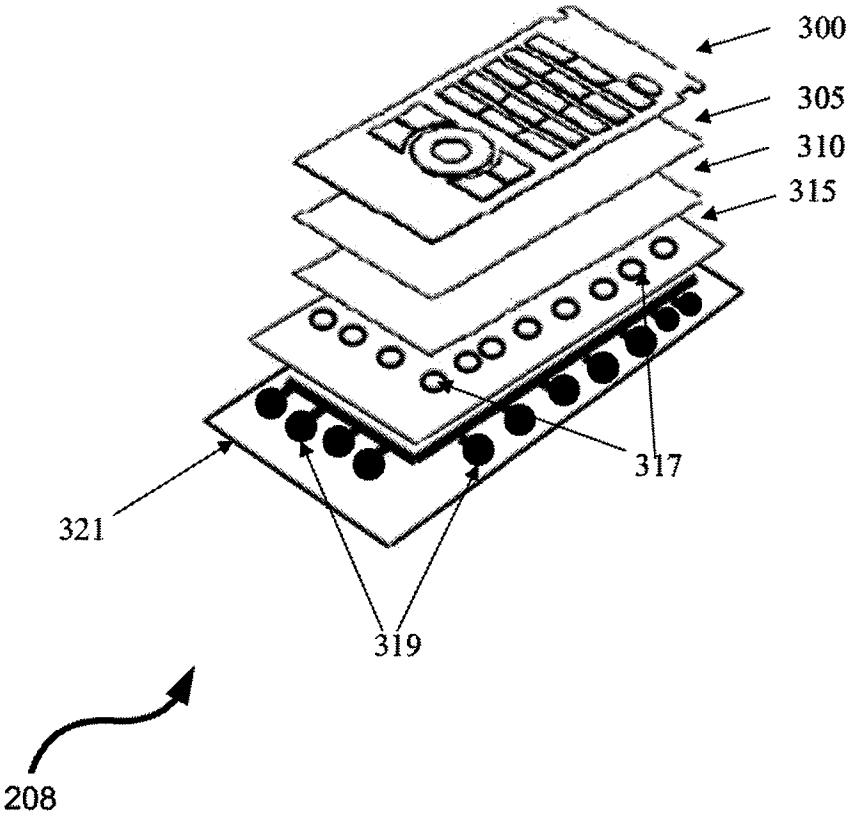
FIG. 3 is an exploded perspective view of the keyboard of the portable electronic device of FIG. 1, according to an implementation.

As shown in FIG. 3, the keyboard 208 comprises a layer of keycaps 300, a layer of flexible transparent touch sensors 305, a layer of flexible output device 310, a dome sheet 315, and a circuit board (PCB) 321. The layer of keycaps 300 comprises a plurality of keys and is a passive layer disposed as the top most layer of the keyboard 208. The keycaps 300 are configured to protect the lower layers from physical damage and to demarcate the keys of the keyboard 208.

The layer of flexible transparent touch sensors 305 comprises capacitive touch sensors. It will be understood that other touch sensors are possible, such as resistive touch sensors. The layer of flexible transparent touch sensors 305 is capable of receiving touch input. Input data representative of touch input (i.e., input that does not result in a tactile feedback) received by the layer of flexible transparent touch sensors 305 is transmitted to the processor 200 (see FIG. 4). For the purpose of this application, unless otherwise specified, touch input comprises input data representative of touch input received by the processor 200 from the layer of flexible transparent touch sensors 305. Touch input can comprise the location from which the touch input was received, and pressure or force can be deduced from the size and/or shape of the touch input. Multi-touch input can also be utilized in the present disclosure.

The dome sheet 315 comprises a plurality of domes 317 spaced from each other according to the layout of the keyboard 208. Each dome 317 comprises a sensor to receive "key click" input from the depression of that key. The compression or collapsing of the dome 317 results in a tactile feedback or "key click", indicating to the user that the key has been pressed and that input has been sent to the processor 200 (see FIG. 4). More specifically, during key click input, a key is depressed and the corresponding dome 317 compresses and contacts a corresponding circuit trace 319 on the circuit board 321, sending an input to the processor 200. For the purpose of this application, unless otherwise specified, key click input comprises input data representative of key click input received by the processor 200 from the contact of the domes 317 with the corresponding circuit traces 319.

Figure 4:
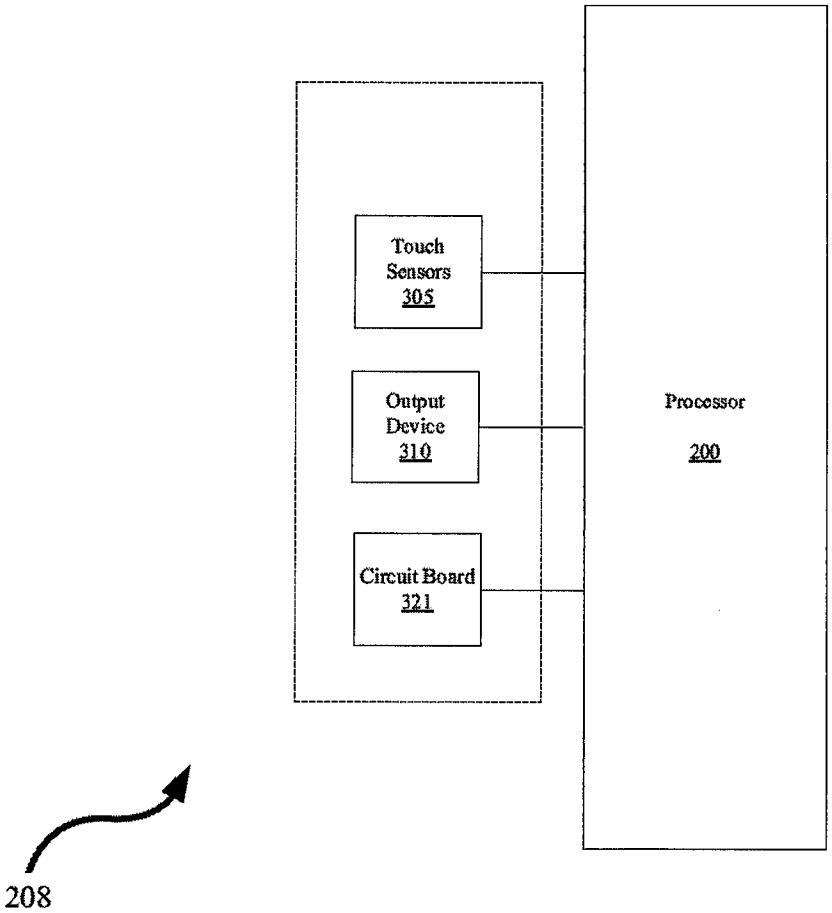
FIG. 4 is a block diagram of the layers of the keyboard of FIG. 3.

FIG. 4 depicts the layers of the keyboard 208 that are accessible by the processor 200. The processor 200 can receive input from the layer of flexible transparent touch sensors 305 and the contact of the domes 317 of the dome sheet 315 with corresponding circuit traces 319 (see FIG. 3) on the circuit board 321. The keyboard 208 can operate in an inactive mode, the first 100-M1, and the second mode 100-M2. The processor 200 can control the layer of flexible output device 310 to display information according to the mode of the keyboard.

The present disclosure provides details where the first mode 100-M1 is a keypad, key-click, or tactile feedback mode, and the second mode 100-M2 is a navigation, touch, or gesture input mode. However, it is understood that more than two mode or other modes or both are contemplated.

When operating in the keypad mode 100-M1, individual key caps are depressed, collapsing the respective domes 317 and providing input to the processor 200 via the circuit traces 319. When operating in the navigation mode 100-M2, the key caps and corresponding domes are not depressed, but rather the user swipes/slides their finger (or an input device such as a stylus) across the key caps, with the input being recognized by the corresponding touch sensors 305. In other words, the present disclosure provides a single keyboard 208 that is configured for providing both key click input and touch input. It is further contemplated that such a configuration enables the form factor of the device 200 to remain small and compact, as it is not necessary to provide both a touch screen and a physical keyboard with depressible keys.

Figure 5:
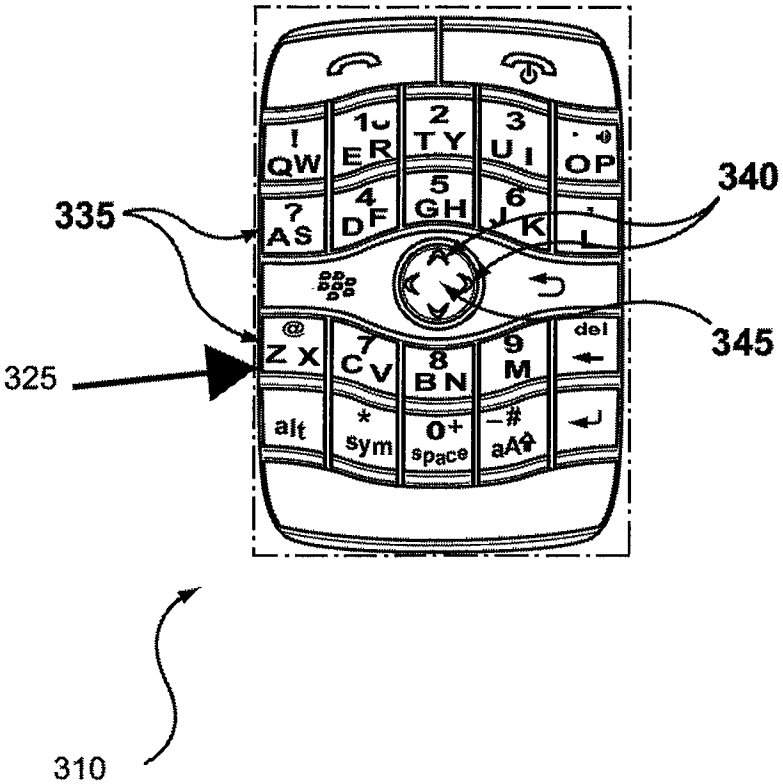
FIG. 5 is a top view of a first indicia disposed on a layer of flexible output device of the keyboard of FIG. 3.

FIG. 5 depicts a first indicia 325 disposed on output device 310 when keyboard 208 is operating in the first or keypad mode 100-M1. That is, the keyboard 208 presents the first indicia 325 to indicate that the keyboard 208 can receive and process key click input. The first indicia 325 comprise first input keys 335, which in this embodiment can be alphanumeric characters 335 and four navigation chevrons 340 emanating from the center of a second input key 345, which in some embodiments can be a navigation key 345.

Figure 6:
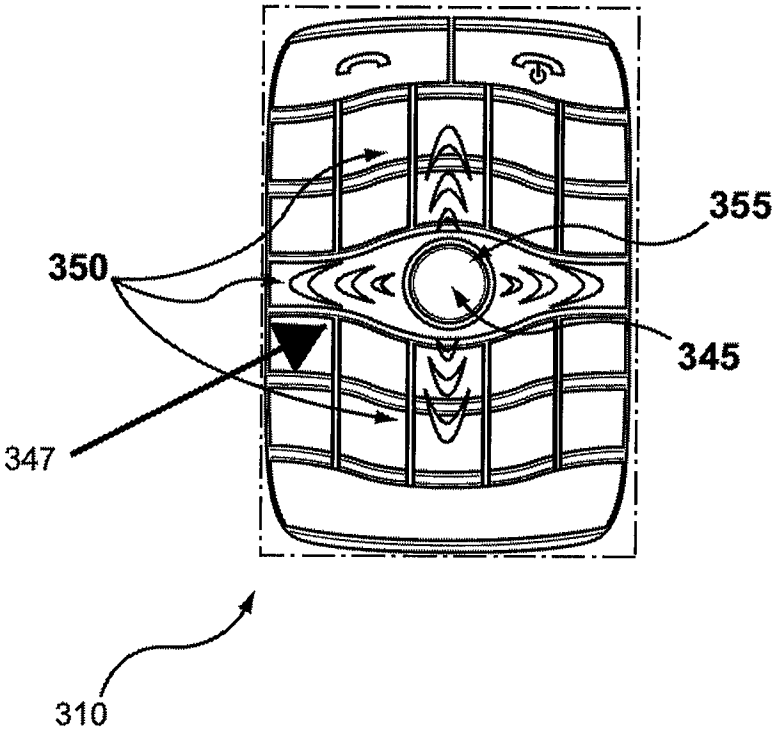
FIG. 6 is a top view of a second indicia disposed on the layer of flexible output device of the keyboard of FIG. 3.

FIG. 6 depicts the second indicia 350 disposed on output device 310 when keyboard 208 is operating in the second or navigation mode 100-M2. The second indicia 347 comprise four sets of chevrons 350 emanating from a common center. Each set of chevrons 350 is oriented substantially perpendicular to its neighbouring sets of chevrons 350. The second indicia 347 further comprise a ring 355 circumscribing the navigation key 345. That is, the keyboard 208 presents the second indicia 325 to indicate that the keyboard 208 can receive and process touch input from the surface of the keyboard 208, including the locations of the chevrons 350.

Both touch input and key click input can be received from the navigation key 345. The navigation key 345 can be a key dedicated to switching from the first mode 100-M1 to the second mode 100-M2 (either by receiving key click input or touch input at the navigation key 345) and to provide a means to input a selection. Alternatively, the processor 200 can be programmed to automatically switch between the first and second modes based on an active application (i.e., the keyboard 208 can operate in the first mode 100-M1 when an email application is in use, and can operate in second mode 100-M2 when a browser application is in use) or based on predetermined criteria set up by the user.

Figure 7:
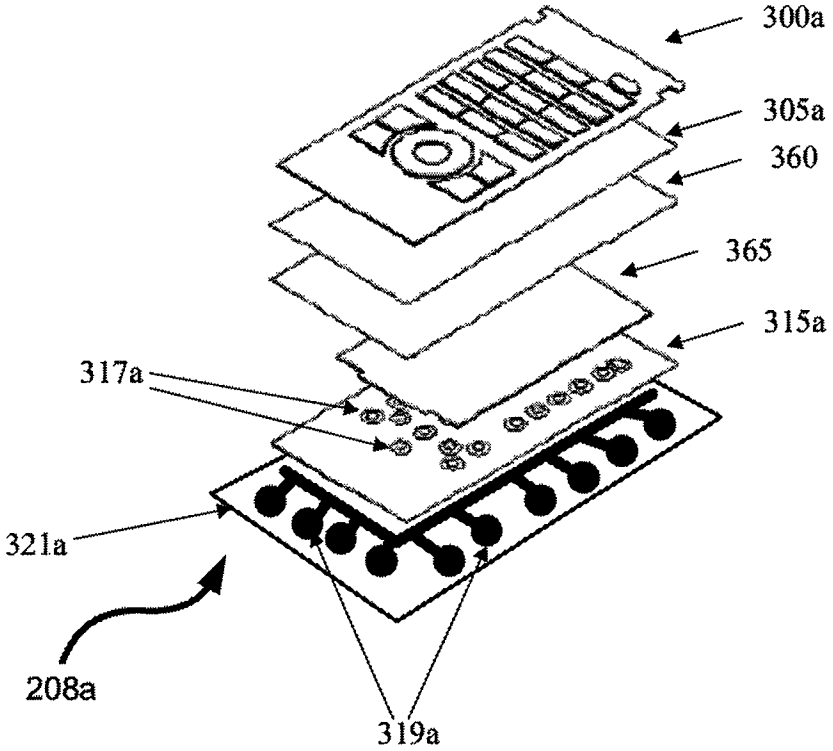
FIG. 7 is an exploded perspective view of the keyboard of the portable electronic device of FIG. 1, according to another implementation.

Referring to FIG. 7, a specific contemplated variation of keyboard 208 (see FIGS. 3 and 4) is indicated at 208*a*. Keyboard 208*a* contains several of the same components as keyboard 208, or variations on them, and accordingly, like components bear like references, except followed by the suffix "a". Of note is that in keyboard 208*a*, a first light guide film 360 and a second light guide film 365 replace the layer of flexible output device 310. The first light guide film 360 and the second light guide film 365 can comprise, for example, commercially available light guide films such as those sold by Silitech®. Generally, a light guide film can comprise indicia and light emitting diodes (LEDs). Activating a light guide film comprises turning on the LEDs to illuminate the indicia on the light guide film.

Figure 8:
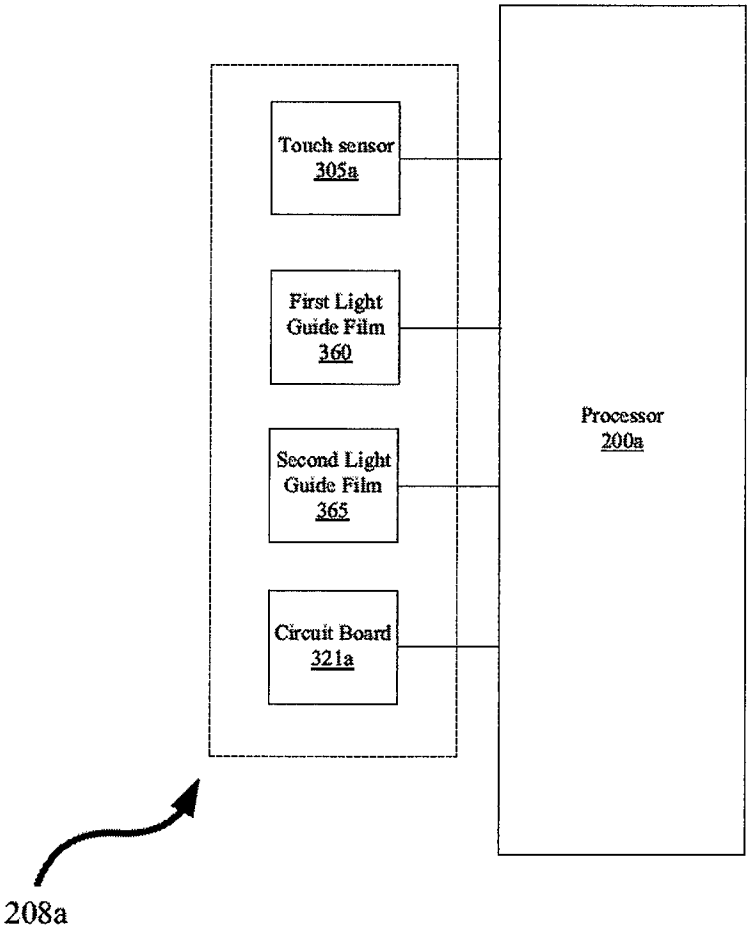
FIG. 8 is a block diagram of the layers of the keyboard of FIG. 7.

FIG. 8 depicts the layers of the keyboard 208*a* that are accessible by the processor 200*a*. The processor 200*a* can receive input from the layer of flexible transparent touch sensors 305*a* and the contact of domes 317*a* with corresponding circuit traces 319*a* on circuit board 321*a* (see also FIG. 7). The processor 200*a* can control (for example, activate or deactivate) the first light guide film 360 and the second light guide film 365.

Figure 9:
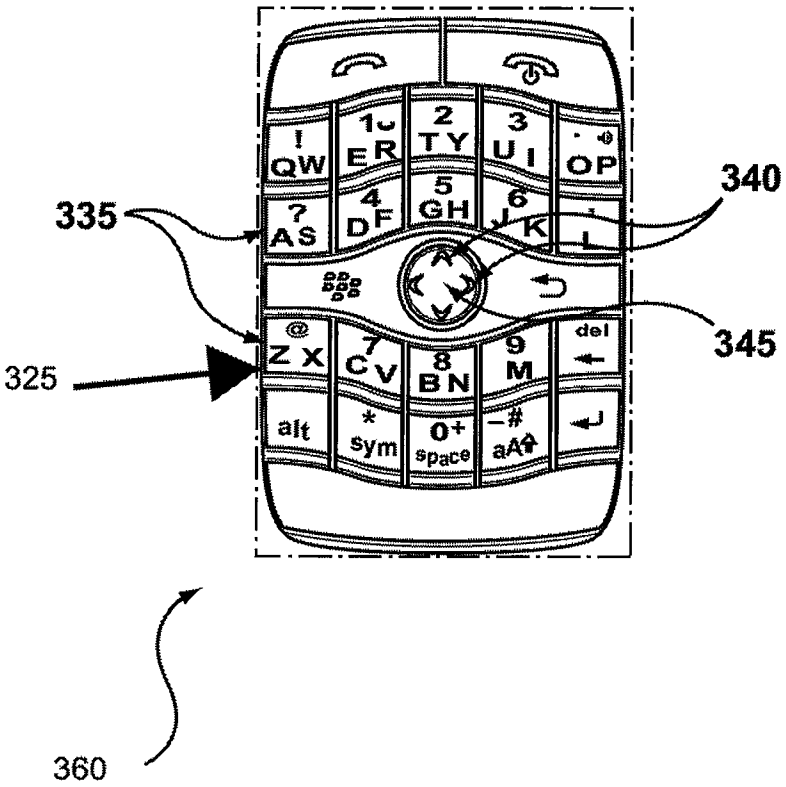
FIG. 9 is a top view of a first indicia disposed on a first light guide film of the keyboard of FIG. 7.

FIG. 9 depicts the first indicia 325, as described above, disposed on the first light guide film 360. Activating the first light guide film 360 comprises illuminating the alphanumeric characters 335 and the navigation chevrons 340 with the LEDs (not shown) of the first light guide film 360. The illuminated alphanumeric characters 335 indicate that the keyboard 208*a* is operating in the first mode 100-M1 and is capable of receiving and processing key click input.

Figure 10:
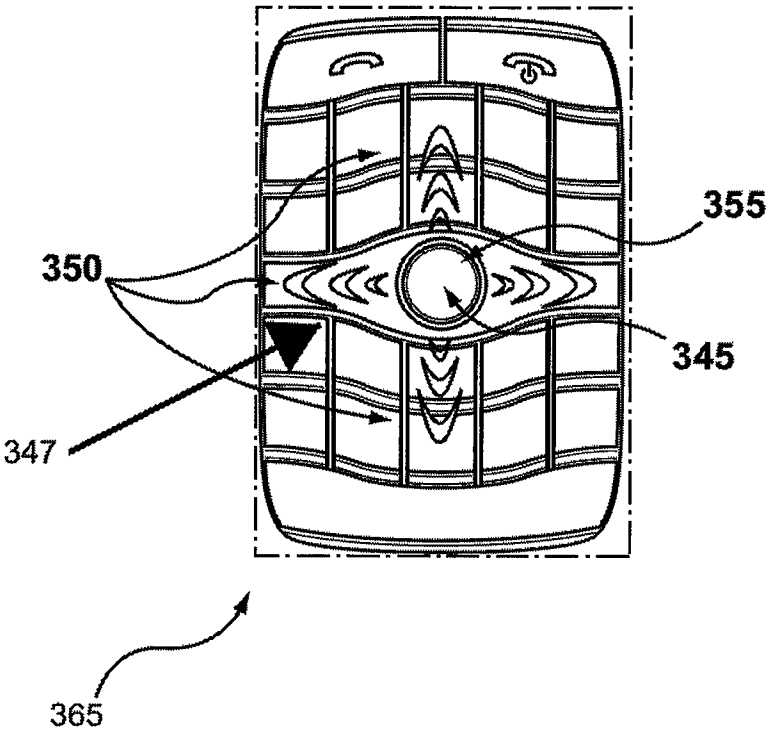
FIG. 10 is a top view of a second indicia disposed on a second light guide film of the keyboard of FIG. 7.

FIG. 10 depicts the second indicia 347 disposed on the second light guide film 365. Activating the second light guide film 365 comprises illuminating the second indicia with the LEDs (not shown) of the second light guide film 365. The illuminated sets of chevrons 350 indicate that the keyboard 208*a* is operating in the second mode 100-M2 and is capable of receiving and processing touch input.

Figure 11:
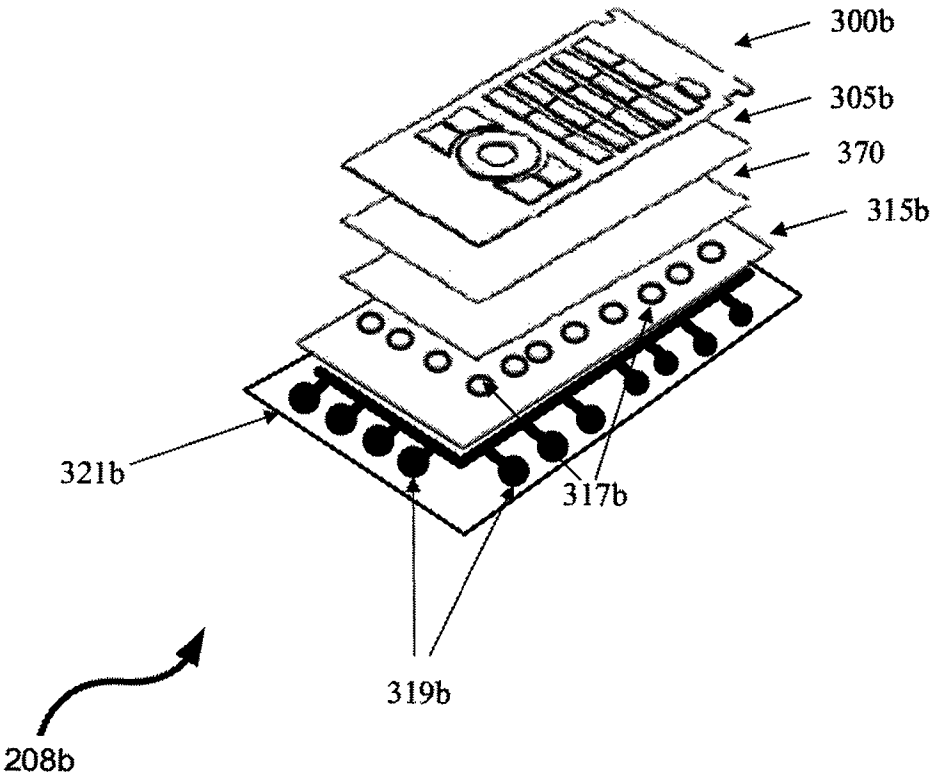
FIG. 11 is an exploded perspective view of the keyboard of the portable electronic device of FIG. 1, according to yet another implementation.

Referring to FIG. 11, another specific contemplated variation of keyboard 208 (see FIGS. 3 and 4) is indicated at 208*b*. Keyboard 208*b* contains several of the same components as keyboard 208, or variations on them, and accordingly, like components bear like references, except followed by the suffix "b". Of note is that in keyboard 208*b*, a layer of flexible display 370 replaces the layer of flexible output device 310. The layer of flexible display 370 can also comprise a flexible OLED display, or in some cases an e-ink display. The layer of flexible display 370 can display the first indicia 325 or the second indicia 347 depending on the active mode of the keyboard 208*b*. The first indicia 325 and second indicia 347 are substantially the same as those described above. The layer of flexible display 370 is flexible enough to enable the dome sheet 315*b* to receive key click input applied to a surface of the layer of keycaps 300*b* that is distal from the dome sheet 315*b*. When the keyboard 208*b* is operating in the keypad mode 100-M1, the layer of flexible display 370 displays the first indicia (i.e., alphanumeric characters 355). When the keyboard 208*b* is operating in the navigation mode 100-M2, the layer of flexible display 370 displays the second indicia (i.e., sets of chevrons 350).

Figure 12:
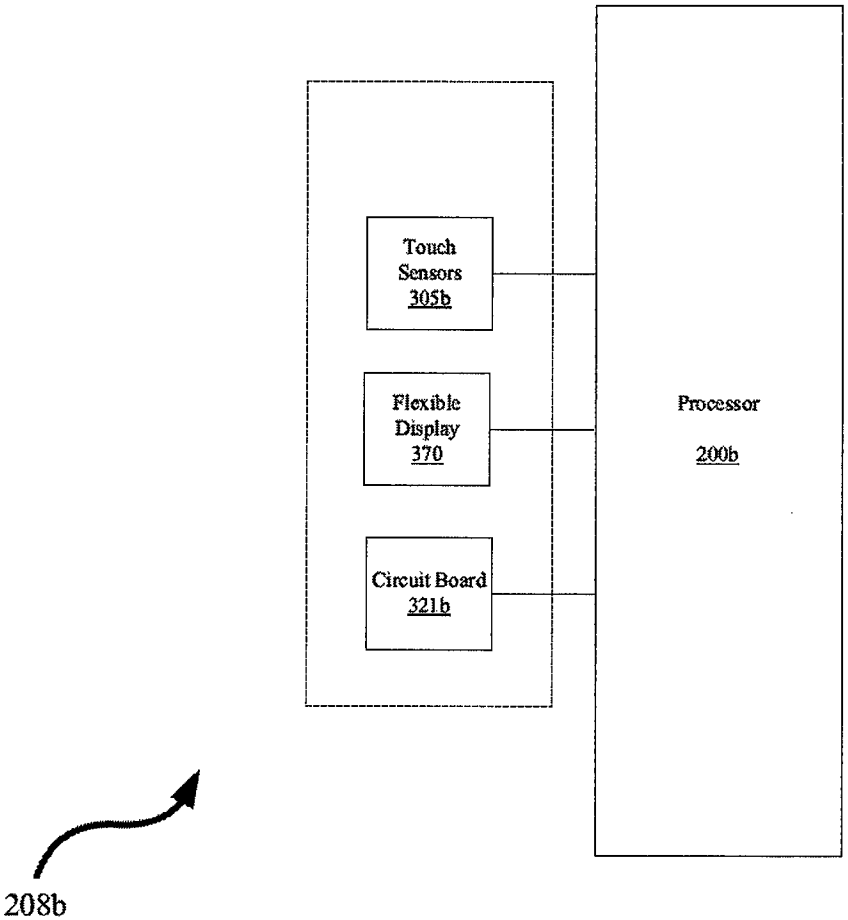
FIG. 12 is a block diagram of the layers of the keyboard of FIG. 11.

FIG. 12 depicts the layers of the keyboard 208*b* that are accessible by the processor 200*b*. The processor 200*b* can receive input from the layer of flexible display 370 and the contact of the domes 317 with corresponding circuit traces on the circuit board 321*b* (see also FIG. 11). The processor 200*b* can also output onto the layer of flexible display 370 by instructing the layer of flexible display 370 to render images such as the first indicia 325 and second indicia 347.

Figure 13:
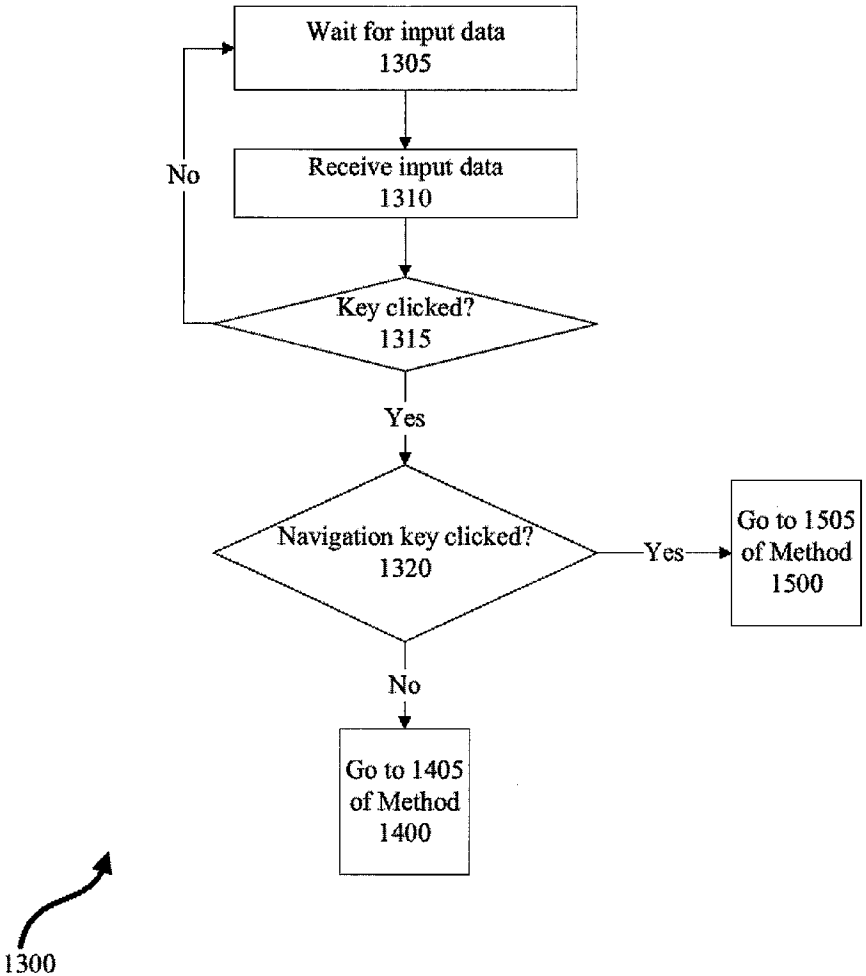
FIG. 13 is a flowchart showing a method for turning on the keyboard.

FIG. 13 depicts a method 1300 that can be performed by the processor 200 for turning on the keyboard 208, 208*a*, or 208*b* from an inactive mode. Block 1305 comprises waiting for input data. For example, the processor 200 waits for input data from the keyboard 208, 208*a*, or 208*b*. Block 1310 comprises receiving input data. For example, the processor 200 receives input data from the keyboard 208, 208*a*, or 208*b*. Block 1315 comprises determining whether a key click input was received from block 1310. For example, the processor 200 compares the input data received from block 1310 to data representative of key click input. When the input data is not equal to data representative of key click input (e.g., the input data equals to data representative of touch input received from the layer of flexible transparent touch sensors 305), the method 1300 returns to block 1305. When the input data equals data representative of key click input, the method 1300 advances to block 1320.

Block 1320 comprises determining whether navigation key click input was received from block 1310. For example, the processor 200 compares the input data from block 1310 to data representative of second input key or navigation key click input. When the input data equals to data representative of navigation key click input, the method 1300 advances to block 1505 of the method 1500. That is, the keyboard 208, 208*a*, or 208*b* enters the navigation mode 100-M2. More details of the method 1500 will be provided below. When the input data is not equal to data representative of navigation key click input (that is, a key click input was received from a first input key 355 [i.e., a key other than the navigation key 345]), the method 1300 advances to block 1405 of the method 1400. That is, the keyboard 208, 208*a*, or 208*b* enters the keypad mode 100-M1. More details of the method 1400 will be provided below.

Figure 14:
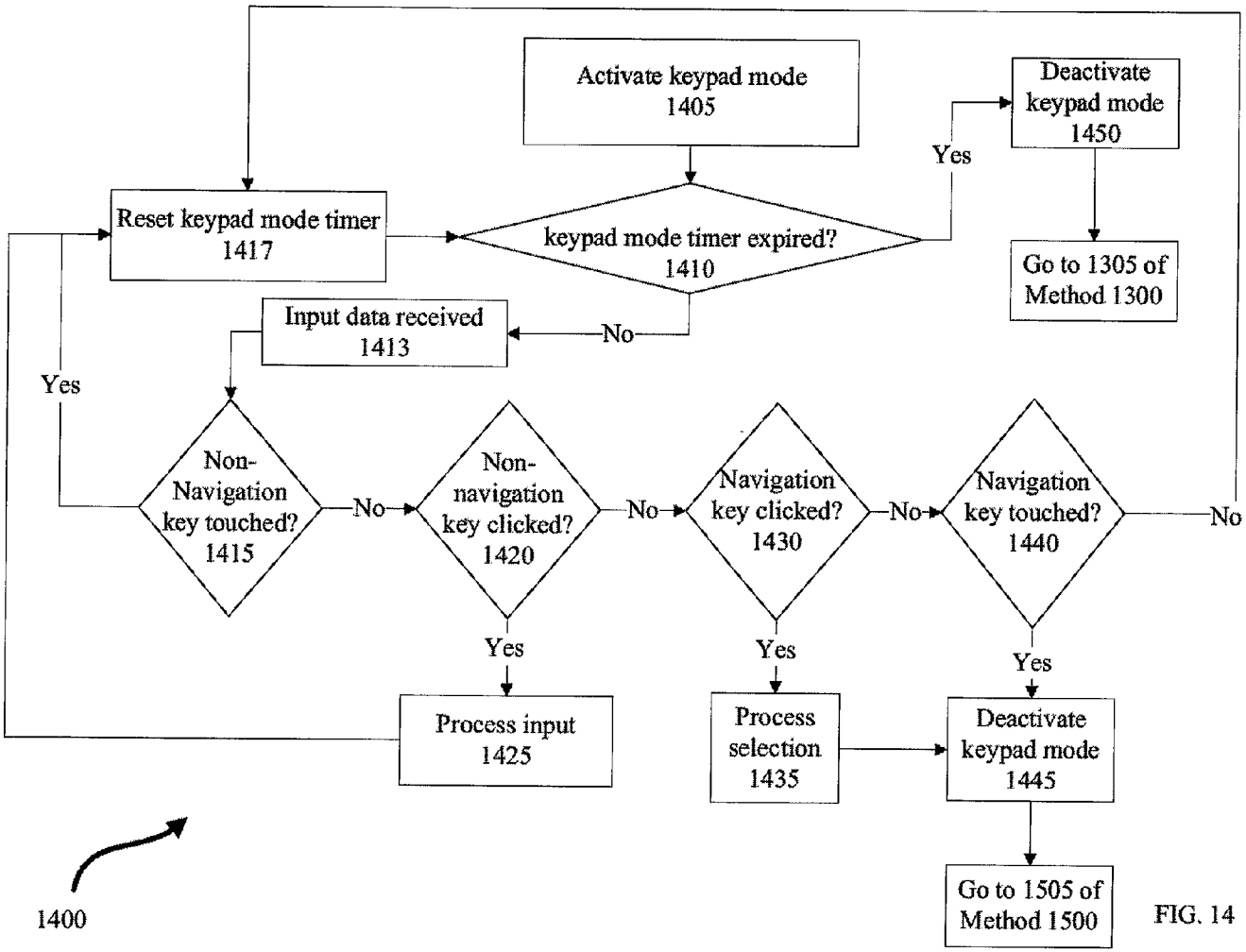
FIG. 14 is a flowchart showing a method for processing input when the keyboard is operating in a first mode.

FIG. 14 depicts a method 1400 performed by the processor 200 to process input when the keyboard 208, 208*a*, or 208*b* operates in the keypad mode 100-M1.

Block 1405 comprises activating keypad mode 100-M1. For example, the processor 200 displays the first indicia 325 on the layer of flexible output device 310 and starts the keypad mode timer 212 (see FIG. 2) for timing switching between the keypad mode and the inactive mode. The keypad mode timer 212 can also be a software delay. The duration of the keypad mode timer 212 can be arbitrarily set to a default value, pre-programmed when the portable electronic device 100 is initially configured, or specified by the user of the portable electronic device 100, etc. As explained above, the first indicia 325 comprise the alphanumeric characters 335 and the navigation chevrons 340. In the keyboard 208*a* implementation, displaying the first indicia 325 comprises activating the first light guide film 360. Activating the first light guide film 360 comprises illuminating the first indicia with the LEDs (not shown) of the first light guide film 360. In the keyboard 208*b* implementation, displaying the first indicia 325 comprises displaying the first indicia 325 on the layer of flexible display 370.

Block 1410 comprises determining whether the keypad mode timer 212 has expired. For example, the processor 200 compares the state of the keypad mode timer 212 to a condition representative of the keypad mode timer 212 having expired (for example, if the keyboard 208 has not been in use for a predetermined period of time [such as 60 seconds, for example]). When the state of the keypad mode timer 212 is not equal to the condition representative of the keypad mode timer 212 having expired, the method 1400 advances to block 1413.

Block 1413 comprises receiving input data from the keyboard 208, 208*a*, or 208*b*. For example, the processor 200 receives input data from the keyboard 208, 208*a*, or 208*b*. Block 1415 comprises determining whether non-navigation key touch input has been received. For example, the processor 200 compares the input data received from block 1413 to data representative of non-navigation key touch input (i.e., touch input such as swiping movement across one or more of the second input keys 335 that does not result in depression of the corresponding domes 317). When the input data equals data representative of non-navigation key touch input, the method 1400 advances to block 1417.

Block 1417 comprises resetting the keypad mode timer 212. For example, the processor 200 resets the keypad mode timer 212 (e.g., the keypad mode timer 212 is set to zero and restarted). The method 1400 returns to block 1410. Block 1410 is processed in substantially the same manner as described above. When the input data is not equal to data representative of non-navigation key touch input, the method 1400 advances to block 1420.

Block 1420 comprises determining whether non-navigation key click input has been received. For example, the processor 200 compares the input data to data representative of non-navigation key click input. When the input data equals data representative of non-navigation key click input (i.e., actuation of one of the alphanumeric keys 335, resulting in compression of the corresponding dome 317 and contact with the corresponding circuit trace 319), the method 1400 advances to block 1425.

Block 1425 comprises processing the input data. For example, the processor 200 processes the input data (e.g., if the portable electronic device 100 is currently waiting to receive typing input for an email application (not shown) and the input data represents a letter "a", the letter "a" is displayed on LCD display 210). After such processing, the method 1400 returns to block 1417. Block 1417 is processed in substantially the same manner as described above. When the input data is not equal to data representative of non-navigation key click input, the method 1400 advances from block 1420 to block 1430.

Block 1430 comprises determining whether navigation key click input has been received. For example, the processor 200 compares the input data to data representative of navigation key click input. When the input data equals to data representative of navigation key click input (i.e., actuation of the navigation key 345 such that the corresponding dome 317 is depressed and contacts the corresponding circuit trace 319), the method 1400 advances to block 1435.

Block 1435 comprises processing the selection that caused the input data to be received from block 1413. For example, if the navigation key click input was received while the cursor (not shown) was on a link to a website, the processor 200 can take appropriate actions to respond to the selection (e.g., launch a web browser (not shown) to access the link).

Block 1445 comprises deactivating the keypad mode 100-M1. For example, the processor 200 clears the first indicia 325 from the layer of flexible output display 310 and turns off the keypad mode timer 212. In the keyboard 208*a* implementation, the processor 200*a* deactivates the first light guide film 360 (i.e., there is no backlighting of the keys) and turns off the keypad mode timer 212. In the keyboard 208*b* implementation, the processor 200*b* clears the first indicia 325 from the layer of flexible display 370 and turns off the keypad mode timer 212. The method 1400 advances to block 1505 of the method 1500 to start the second mode 100-M2. That is, block 1445 prepares the keyboard 208, 208*a*, 208*b* to switch from the first mode 100-M1 to the second mode 100 M2 by turning off the first mode 100-M1. When the input data is not equal to data representative of navigation key click input, the method 1400 advances to block 1440.

Block 1440 comprises determining whether navigation key touch input has been received. For example, the processor 200 compares the input data to data representative of navigation key touch input (i.e., touch input on the navigation key that does not result in depression of the corresponding dome 317). When the input data equals to data representative of navigation key touch input, the method 1400 advances to block 1445. Block 1445 is processed in substantially the same manner as described above. When the input data is not equal to data representative of navigation key touch input, the method 1400 advances to block 1417. Block 1417 is processed in substantially the same manner as described above.

When the keypad mode timer 212, from the comparison made in block 1410, equals to the condition representative of the keypad mode timer 212 having expired, the method 1400 advances to block 1450. Block 1450 is processed in substantially the same manner as block 1445, such that the keypad mode 100-M1 is deactivated. The method 1400 advances to block 1305 of the method 1300. That is, the keyboard 208, 208*a*, or 208*b* is placed in the inactive mode.

In the implementations employing the use of light guides, when operating in inactive mode, light guides can be turned off such that although the characters on the keyboard 208 can still be seen, there is no backlighting of the keys. When employing an OLED display, which does not include the use of light guides, the inactive mode is such that the OLED has a faded intensity when compared to the first mode 100-M1 and second mode 100-M2.

In some implementations, the keyboard 208 can display alphanumeric characters 335 in the keypad mode 100-M1 with the chevrons 350 displayed in a faded intensity and the keyboard 208 can display chevrons 350 in the navigation mode 100-M2 with the alphanumeric characters 335 in a faded intensity.

Figure 15:
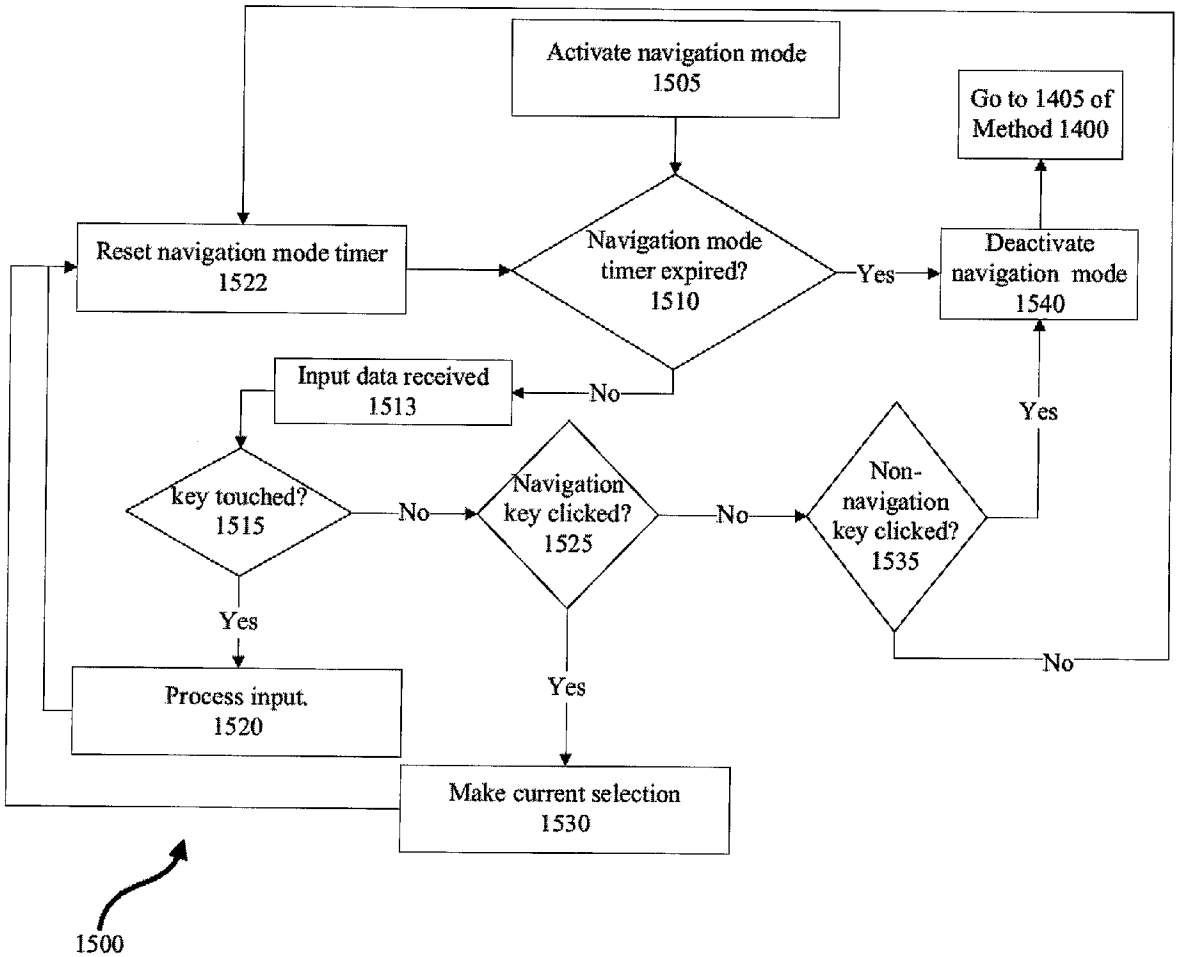
FIG. 15 is a flowchart showing a method for processing input when the keyboard is operating in a second mode.

FIG. 15 depicts a method 1500 performed by the processor 200 to process input when the keyboard 208, 208*a* or 208*b* is operating in the navigation mode 100-M2.

Block 1505 includes activating navigation mode. For example, the processor 200 displays the second indicia 347 on the layer of flexible output device 310 and starts the navigation mode timer 213 (see FIG. 2) for timing switching between the keypad mode and the navigation mode. The keypad mode timer 213 can also be a software delay. The duration of the navigation mode timer 213 can be arbitrarily set to a default value, pre-programmed when the portable electronic device 100 is initially configured, and specified by the user of the portable electronic device 100, etc. As mentioned above, in the present embodiment, the second indicia 347 comprise the four sets of chevrons 350 and the ring 355. In the keyboard 208*a* implementation, displaying the second indicia comprises activating the second light guide film 365. Activating the second light guide film 365 comprises illuminating the second indicia 347 with the LEDs (not shown) of the second light guide film 365. In the keyboard 208*b* implementation, displaying the second indicia 347 comprises displaying the second indicia 347 on the layer of flexible display 370.

Block 1510 comprises determining whether the navigation mode timer 213 has expired. For example, the processor 200 compares the state of the navigation mode timer 213 to a condition representative of the navigation mode timer 213 having expired (for example, if the keyboard 208 has not been in use for a predetermined period of time [such as 60 seconds, for example]). When the state of the navigation mode timer 213 is not equal to the condition representative of the navigation mode timer 213 having expired, the method 1500 advances to block 1513.

Block 1513 comprises receiving input data from the keyboard 208, 208*a* or 208*b*. For example, the processor 200 receives input data from the keyboard 208, 208*a*, 208*b*, such as a swiping movement across the keycaps in an upward direction.

Block 1515 comprises determining whether key touch input has been received. For example, the processor 200 compares the input data (i.e., the swiping movement described above) received from block 1513 to data representative of key touch input (i.e., input that does not result in depression of the corresponding domes 317). When the input data equals data representative of key touch input, the method 1500 advances to block 1520.

Block 1520 comprises processing the input data. For example, processor 200 processes the input data (e.g., if the portable electronic device 100 is currently waiting to receive pointer movement input for a map application (not shown) and the input data represents a movement to the left, the pointer (not shown) on LCD display 210 is displayed as being moved to the left).

At block 1522, the processor 200 resets the navigation mode timer 213 (for example, the navigation mode timer 213 is set to zero and restarted). The method 1500 returns to block 1510. Block 1510 is processed in substantially the same manner as described above. When the input data does not equal to data representative of key touch input, the method 1500 advances to block 1525.

Block 1525 comprises determining whether navigation key click input has been received. For example, the processor 200 compares the input data to data representative of navigation key click input (i.e., key click input received from second input key 345). When the input data equals to data representative of navigation key click input, the method 1500 advances to block 1530.

Block 1530 comprises processing the selection that caused the input data to be received from block 1513. For example, if the navigation key click input was received while the cursor (not shown) was on a link to a website, the processor 200 can take appropriate actions to respond to the selection (e.g., launch a browser (not shown) to access the link). The method 1500 then returns to block 1522. Block 1522 is processed in substantially the same manner as described above. When the input data does not equal data representative of navigation key click input, the method 1500 advances to block 1535.

Block 1535 comprises determining whether non-navigation key click input has been received. For example, the processor 200 compares the input data to data representative of non-navigation key click input (i.e., key click input received from first input key 335). When the input data equals data representative of non-navigation key click input, the method 1500 advances to block 1540.

Block 1540 comprises deactivating the navigation mode. For example, the processor 200 clears the second indicia 347 from the layer of flexible output display 310 and turns off the navigation mode timer 213. In the keyboard 208*a* implementation, the processor 200 deactivates the second light guide film 365 and turns off the navigation mode timer 213. In the keyboard 208*b* implementation, the processor 200*b* clears the second indicia 347 from the layer of flexible display 370 and turns off the navigation mode timer 213. The method 1500 advances to block 1405 of the method 1400. That is, the keyboard 208, 208*a*, or 208*b* enters the keypad mode 100-M1. When the input data is not equal to data representative of non-navigation key click input, the method 1500 advances to block 1522. Block 1522 is processed in substantially the same manner as described above.

When the navigation mode timer 213, from the comparison made in block 1510, equals to the condition representative of the navigation mode timer 213 having expired, the method 1500 advances to block 1540. Block 1540 is processed in substantially the same manner as described above. The method 1500 advances to block 1405 of the method 1400. That is, the keyboard 208, 208*a*, or 208*b* enters the keypad mode 100-M1.

It is understood that the first and second modes of the keyboard 208 can include additional modes (with additional layouts in which other characters are displayed on the flexible output device 310) other than those described above. For example, the flexible output device 310 could also include a numeric mode (where the display includes a telephone dial pad layout), an alphabetic mode (where the display includes alphabetic characters only layout), a symbol mode (where common symbols and characters such as "/", "?", "!", and "@" are arranged, for example), a gaming mode, a gesture arrow mode, a command mode (for example, when in an email application, the keyboard could display commands/icons for "reply", "forward", "send", and "delete"), a secondary language mode, a scrolling mode (where vertical arrows appear on the keyboard 208, 208*a*, 208*b* such that the user can gesture up/down to initiate scrolling of a page on the display) and a virtual navigation module mode. In the keyboard 208*a* implementation, including additional layout comprises including additional light guide films. In the keyboard 208*b* implementation, including additional layouts comprises configuring the processor 208*b* to generate the additional layouts on the layer flexible display 370.

Those skilled in the art will now recognize certain advantages from this specification. A portable electronic device typically has limited space on its keyboard. The functionalities of portable electronic devices are increasing and becoming more diverse increasing the need for the portable electronic devices to accept more input as well as accepting more disparate forms of input. This specification can obviate or at least mitigate at least some of these problems by accommodating any number of keyboard layouts. The keyboard 208, 208*a*, 208*b* can be switched between layouts based on input received via keyboard 208, 208*a*, 208*b* or application being utilized. The keyboard 208, 208*a*, 208*b* enables the form factor of the device 100 to remain small and compact, as it is not necessary to provide both a touch screen and a physical keyboard with depressible keys.

It will now be apparent that the blocks of the methods 1300, 1400, and 1500 can be varied and likewise that many specific design choices can be made relative to how to implement various blocks in the methods 1300, 1400, and 1500. In some implementations, the functionality of the portable electronic device 100 can be achieved using a computing apparatus that has access to a code memory (not shown) which stores computer-readable program code for operation of the computing apparatus. The computer-readable program code could be stored on a nontransitory computer readable storage medium which is fixed, tangible and readable directly by these components, (e.g., removable diskette, CD-ROM, ROM, fixed disk, USB drive). Alternatively, the computer-readable program code could be stored remotely but transmittable to these components via a modem or other interface device connected to a network (including, without limitation, the Internet) over a transmission medium. The transmission medium can be either a non-wireless medium (e.g., optical and/or digital and/or analog communications lines) or a wireless medium (e.g., microwave, infrared, free-space optical or other transmission schemes) or a combination thereof.

A portion of the disclosure of this patent document contains material which is subject to copyright protection. The copyright owner has no objection to the facsimile reproduction by any one the patent document or patent disclosure, as it appears in the Patent and Trademark Office patent file or records, but otherwise reserves all copyrights whatsoever.

Persons skilled in the art will appreciate that there are yet more alternative implementations and modifications possible for implementing the implementations, and that the above implementations and examples are only illustrations of one or more implementations. The scope, therefore, is only to be limited by the claims appended hereto.

What is claimed is:

1. A multi-mode keyboard for a portable electronic device, the keyboard comprising:

a layer of keycaps;

a layer of flexible transparent touch sensors positioned below the layer of keycaps, the layer of flexible transparent touch sensors for receiving touch input, wherein the touch input comprises navigation input;

a layer of flexible output device; and a dome sheet positioned below the layer of flexible transparent touch sensors and the layer of flexible output device, the dome sheet for receiving key click input from the layer of keycaps through flexure of the layer of flexible transparent touch sensors and the layer of flexible output device, the dome sheet including a plurality of domes, wherein each dome corresponds to a key click input value, and wherein collapsing of each of the plurality of domes provides a different key click input value.

2. The multi-mode keyboard of claim 1, the keyboard configured for switching from a first mode to a second mode.

3. The multi-mode keyboard of claim 2 wherein the first mode is an alphanumeric keypad mode and the second mode is a navigation mode.

4. The multi-mode keyboard of claim 1, wherein the keyboard is configured for switching from a key click input mode to a touch input mode.

5. The multi-mode keyboard of claim 2, wherein the layer of flexible output device comprises:

a first light guide film having first indicia viewable when the multi-mode keyboard is operating in the first mode; and a second light guide film having second indicia viewable when the multi-mode keyboard is operating in the second mode.

6. The multi-mode keyboard of claim 5, wherein the first indicia comprises at least alphanumeric characters.

7. The multi-mode keyboard of claim 5, wherein the second indicia comprises a plurality of navigation characters.

8. The multi-mode keyboard of claim 5, wherein the second indicia includes one of a telephone dial pad, a gaming layout, a symbol layout, a gesture arrow layout and a command layout.

9. The multi-mode keyboard of claim 1 further including a printed circuit board having a plurality of circuit traces, and wherein the dome sheet includes a plurality of domes, each dome in alignment with a corresponding circuit trace.

10. The multi-mode keyboard of claim 1, wherein the layer of flexible output device comprises a layer of flexible display for displaying first indicia when the multi-mode keyboard is operating in a first mode and for displaying second indicia when the multi-mode keyboard is operating in a second mode.

11. The multi-mode keyboard of claim 10, wherein the second indicia comprise a plurality of navigation characters.

12. The multi-mode keyboard of claim 11, wherein the second indicia includes one of a telephone dial pad, a gaming layout, a symbol layout, a gesture arrow layout and a command layout.

13. A method for controlling a multi-mode keyboard comprising:

receiving first input data via the keyboard; and if the first input data results in a key click input received from a first input key, switching the multi-mode keyboard from an inactive mode to a first mode displaying a first indicia on the keyboard;

if the first input data results in a key-click input received from a second input key, switching the multi-mode keyboard from the inactive mode to a second mode displaying a second indicia on the keyboard; and wherein the first indicia and the second indicia are displayed on a layer of flexible display that flexes to provide the key click input received from the first input key and the key-click input received from the second input key.

14. The method of claim 13, further comprising:

receiving second input data from the keyboard; and if the second input data is a touch input or a key click input received from the second input key, switching the keyboard from the first mode to the second mode;

if the second input data is a key click input received from the first input key, switching from the second mode to the first mode.

15. The method of claim 13 wherein the first mode is a keypad mode and the second mode is a navigation mode.

16. The method of claim 13 wherein the first input key is a non-navigation key and the second input key is a navigation key.

17. A multi-mode keyboard for a portable electronic device having a processor, the keyboard comprising:

a layer of flexible transparent touch sensors for receiving touch input wherein the touch input comprises navigation input;

a flexible display layer configured for displaying at least one indicia thereon;

a dome sheet for receiving key click input, the dome sheet including a plurality of domes, wherein each dome corresponds to a key click input value, and wherein collapsing of each of the plurality of domes provides a different key click input value;

a printed circuit board including a plurality of circuit traces, each circuit trace corresponding to one of the domes;

a layer of keycaps placed on top of said layer of flexible transparent touch sensors, each keycap in alignment with a corresponding one of said domes and a corresponding one of said circuit traces;

wherein the dome sheet is positioned to receive key click input from the layer of keycaps through flexure of the layer of flexible transparent touch sensors and the flexible display layer;

wherein the keyboard is configured for switching between a first mode and a second mode based on whether touch input or key click input is received by the processor.

18. The keyboard of claim 17 wherein the flexible display layer is configured for displaying first indicia when the keyboard operates in the first mode, and second indicia when the keyboard operates in the second mode.

19. The keyboard of claim 17 wherein the first mode includes a keypad mode and the second mode includes a navigation mode.

20. the keyboard of claim 17, wherein the flexible display layer is selected from one of a flexible OLED display and a flexible e-ink display.

* * * * *